US011121451B2

(12) United States Patent
Iwaki et al.

(10) Patent No.: US 11,121,451 B2
(45) Date of Patent: Sep. 14, 2021

(54) ANTENNA DEVICE AND ROUTER UNIT WITH ANTENNA

(71) Applicant: Yazaki Corporation, Tokyo (JP)

(72) Inventors: Takahiro Iwaki, Shizuoka (JP); Naoshi Serizawa, Shizuoka (JP); Tatsuya Ishikawa, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 64 days.

(21) Appl. No.: 16/725,186

(22) Filed: Dec. 23, 2019

(65) Prior Publication Data

US 2020/0243945 A1 Jul. 30, 2020

(30) Foreign Application Priority Data

Jan. 29, 2019 (JP) ..... JP2019-012741

(51) Int. Cl.

| | |
|---|---|
| ***H01Q 1/24*** | (2006.01) |
| ***H01Q 1/48*** | (2006.01) |
| ***H01Q 1/38*** | (2006.01) |
| ***H01Q 1/52*** | (2006.01) |
| ***H01Q 1/32*** | (2006.01) |

(52) U.S. Cl.

CPC ..... *H01Q 1/24* (2013.01); *H01Q 1/3275* (2013.01); *H01Q 1/38* (2013.01); *H01Q 1/48* (2013.01); *H01Q 1/52* (2013.01); *H01Q 1/526* (2013.01)

(58) Field of Classification Search

CPC ..... H01Q 1/24; H01Q 1/3275; H01Q 1/256; H01Q 1/48; H01Q 1/38; H01Q 1/52

USPC ..... 343/713

See application file for complete search history.

(56) References Cited

U.S. PATENT DOCUMENTS

| | | | | |
|---|---|---|---|---|
| 5,300,936 | A | 4/1994 | Izadian | |
| 6,215,454 | B1 * | 4/2001 | Tran | H01Q 1/38 343/841 |
| 2013/0120210 | A1 * | 5/2013 | Zeiger | H01Q 1/3275 343/841 |
| 2016/0036121 | A1 * | 2/2016 | Hayashi | H01Q 1/42 343/713 |
| 2017/0317408 | A1 * | 11/2017 | Hamada | B60R 13/0212 |
| 2018/0294555 | A1 * | 10/2018 | Nagashima | H01Q 1/38 |
| 2019/0273311 | A1 * | 9/2019 | Sampo | H01Q 9/42 |
| 2019/0312342 | A1 * | 10/2019 | Sautter | H01Q 1/02 |

FOREIGN PATENT DOCUMENTS

| | | | |
|---|---|---|---|
| EP | 0590955 | A2 | 9/1993 |
| JP | 2005-286794 | A | 10/2005 |
| JP | 2006-074351 | A | 3/2006 |

(Continued)

*Primary Examiner* — Hai V Tran

(74) *Attorney, Agent, or Firm* — Sughrue Mion, PLLC

(57) ABSTRACT

A router unit with an antenna includes a router and an antenna structure. The antenna structure is mounted in a vehicle, and includes a dielectric body with a dielectric property and a planar element with a conductive property that is provided to the dielectric body. The router includes a transferring unit and a housing. The transferring unit transfers a signal to a transfer destination. The housing houses the transferring unit and includes a shield part with a conductive property for blocking noise that affects the transferring unit. The antenna structure is provided to the shield part, connected to the transferring unit, and transmits or receives a radio wave by using the shield part as a ground of the antenna structure.

5 Claims, 3 Drawing Sheets

(56) References Cited

FOREIGN PATENT DOCUMENTS

| | | | |
|---|---|---|---|
| JP | 2017-200086 | A | 11/2017 |
| JP | 2018-182415 | A | 11/2018 |
| WO | 2017211534 | A1 | 12/2017 |

* cited by examiner

ANTENNA DEVICE AND ROUTER UNIT WITH ANTENNA

CROSS-REFERENCE TO RELATED APPLICATION(S)

The present application claims priority to and incorporates by reference the entire contents of Japanese Patent Application No. 2019-012741 filed in Japan on Jan. 29, 2019.

BACKGROUND OF THE INVENTION

1. Field of the Invention

The present invention relates to an antenna device and a router unit with an antenna.

2. Description of the Related Art

One example of the conventionally known antenna devices is an antenna unit disclosed in Japanese Patent Application Laid-open No. 2018-182415. This antenna unit is mounted in a vehicle and transmits and receives a radio wave. The antenna unit includes a dielectric body formed to have a sheet shape, a planar antenna formed at a front surface of the dielectric body, and a ground formed at a rear surface of the dielectric body. The antenna unit is connected to an electronic component of the vehicle and outputs a received signal to the electronic component.

Incidentally, in the antenna unit according to Japanese Patent Application Laid-open No. 2018-182415, it has been desired that the increase in the number of components of the antenna unit is suppressed and moreover, the attenuation of a signal after being output from the antenna unit and before reaching the electronic component is suppressed.

SUMMARY OF THE INVENTION

The present invention has been made in view of the above circumstances, and an object is to provide an antenna device and a router unit with an antenna in which the increase in the number of components and the attenuation of a signal can be suppressed.

In order to solve the above mentioned problem and achieve the object, a antenna device according to one aspect of the present invention includes an antenna structure that is mounted in a vehicle, and includes a dielectric body with a dielectric property and an antenna element with a conductive property that is provided to the dielectric body, wherein in a router including a transferring unit that transfers a signal to a transfer destination and a housing that houses the transferring unit and includes a shield part with a conductive property for blocking noise that affects the transferring unit, the antenna structure is provided to the shield part, connected to the transferring unit, and transmits or receives a radio wave by using the shield part as a ground of the antenna structure.

According to another aspect of the present invention, in the antenna device, it is preferable that the antenna structure transmits the signal, which is output from the transferring unit, to a communication system outside the vehicle or outputs the signal, which is received from the communication system outside the vehicle, to the transferring unit.

According to still another aspect of the present invention, in the antenna device, it is preferable that the shield part is larger than the antenna element when viewed from a stacking direction of a pattern of the antenna element stacked on the dielectric body.

According to still another aspect of the present invention, in the antenna device, it is preferable that the dielectric body is formed to have a sheet shape, is disposed to face the shield part with a distance therebetween, and includes a bent part corresponding to one end of the dielectric body disposed to face the shield part, the one end being bent toward the shield part, the antenna element is provided to the dielectric body on a side of the shield part and includes a capacitive coupling part that is capacitively coupled with the shield part in a manner that a part of the antenna element is overlapped with the shield part through the dielectric body at the bent part, and the antenna structure transmits or receives the radio wave by using the shield part as the ground of the antenna structure.

In order to achieve the object, a router unit with an antenna according to still another aspect of the present invention includes an antenna structure that is mounted in a vehicle, and includes a dielectric body with a dielectric property and an antenna element with a conductive property that is provided to the dielectric body; and a router including a transferring unit that transfers a signal to a transfer destination and a housing that houses the transferring unit and includes a shield part with a conductive property for blocking noise that affects the transferring unit, wherein the antenna structure is provided to the shield part, connected to the transferring unit, and transmits or receives a radio wave by using the shield part as a ground of the antenna structure.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A mode for carrying out the present invention (embodiment) is described in detail with reference to the drawings. However, the present invention is not limited by the content described in the embodiment below. In addition, the component described below includes the component that is easily conceived by a person skilled in the art or that is substantially the same. Furthermore, the structures described below can be combined with each other. Moreover, the structures can be omitted, replaced, or changed variously within the range not departing from the scope of the present invention.

EMBODIMENT

Figure 1:
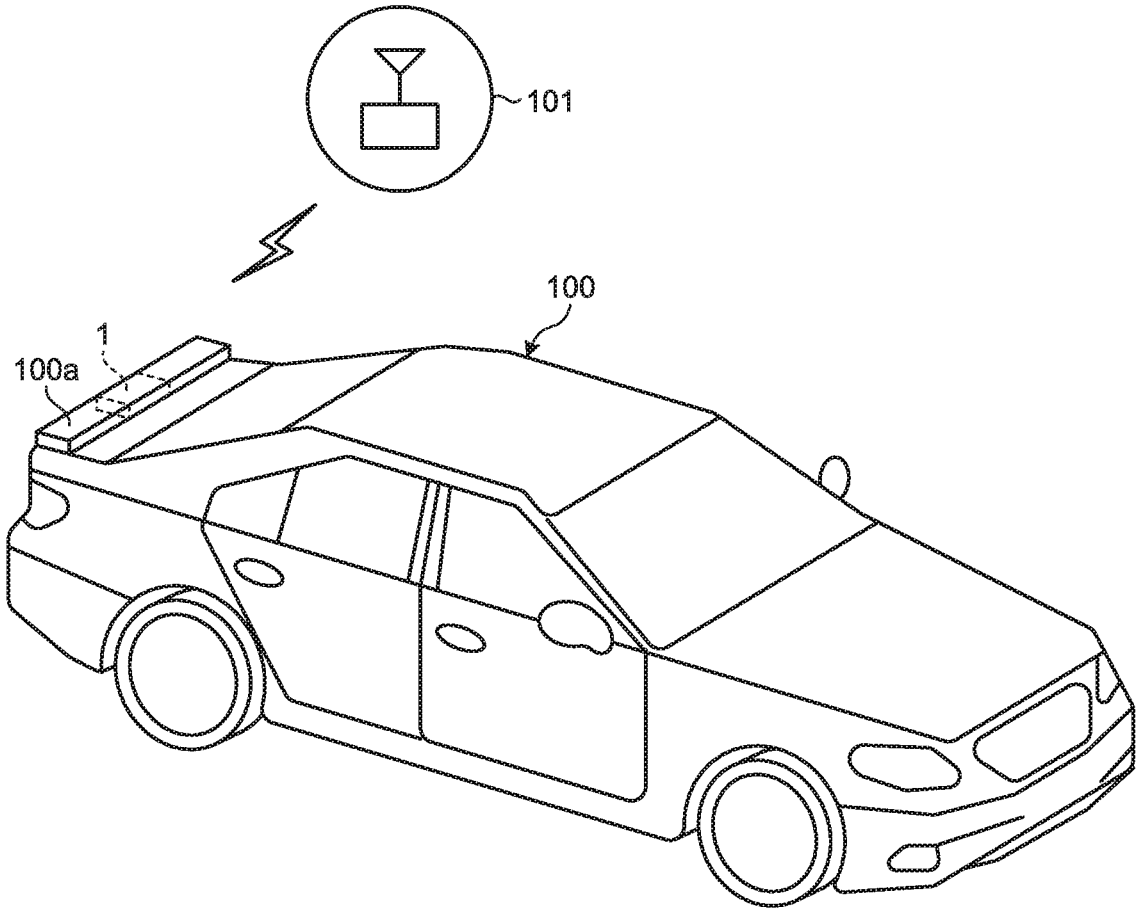
FIG. 1 is a schematic view illustrating an example in which a router unit with an antenna according to one embodiment is mounted.
Figure 2:
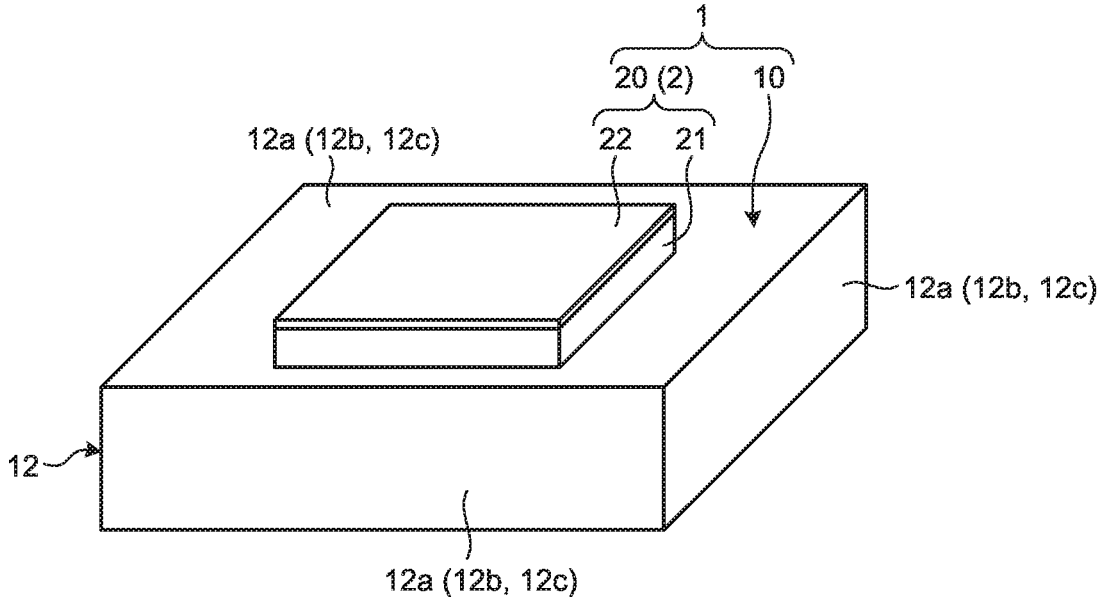
FIG. 2 is a perspective view illustrating a structure example of the router unit with the antenna according to the embodiment.
Figure 3:
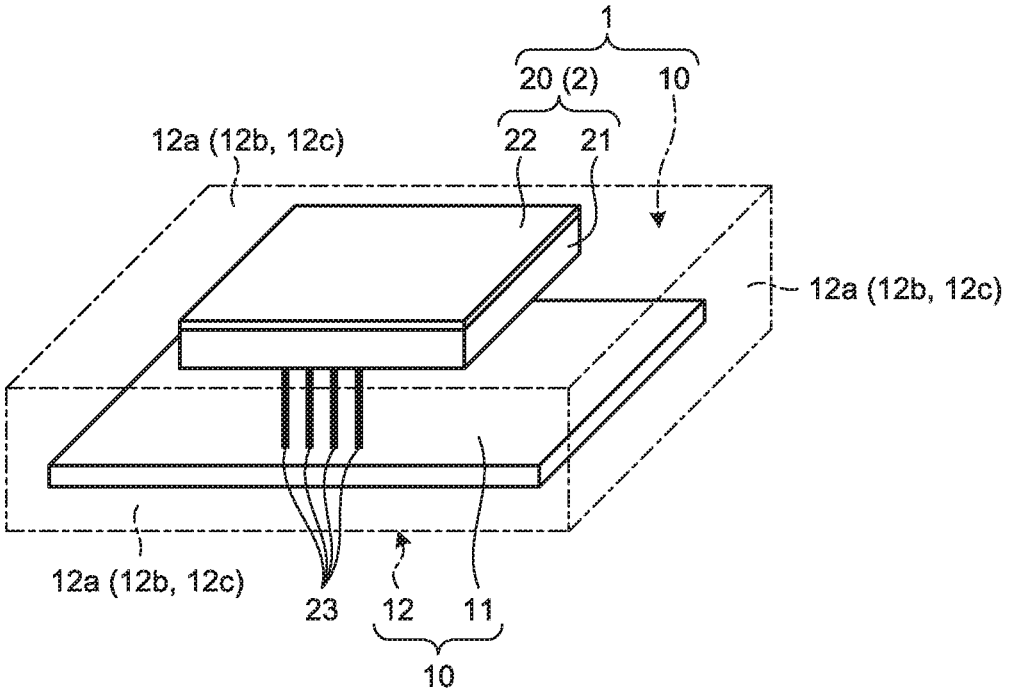
FIG. 3 is a perspective view illustrating an example in which an antenna structure and a transferring unit according to the embodiment are connected.

A router unit 1 with an antenna and an antenna device 2 according to an embodiment are described with reference to the drawings. FIG. 1 is a schematic view illustrating an example in which the router unit 1 with the antenna according to the embodiment is mounted. FIG. 2 is a perspective view illustrating a structure example of the router unit 1 with the antenna according to the embodiment. FIG. 3 is a perspective view illustrating an example in which an antenna structure 20 and a transferring unit 11 according to the embodiment are connected.

The router unit 1 with the antenna has a function of transmitting or receiving a signal, and a function of transferring the signal. The router unit 1 with the antenna is mounted in a vehicle 100, and in this example, placed in a rear spoiler 100*a* of the vehicle 100 as illustrated in FIG. 1. The router unit 1 with the antenna is housed in an internal space of the rear spoiler 100*a* and fixed thereto, for example. Note that the position of the router unit 1 with the antenna is not limited to the rear spoiler 100*a* and may be at any place in the vehicle 100 where the transmission and reception of a radio wave are possible.

The router unit 1 with the antenna includes a router 10 and the antenna structure 20 as illustrated in FIG. 2 and FIG. 3. The router 10 transfers a signal to a transfer destination. The router 10 includes the transferring unit 11 and a housing 12. The transferring unit 11 is housed in an internal space of the housing 12, and is connected to a planar element 22 of the antenna structure 20 and an electronic device in the vehicle as will be described below. The transferring unit 11 includes a routing table where the transfer destination is written, and on the basis of the routing table, transfers the signal, which is output from the planar element 22 of the antenna structure 20, to the electronic device in the vehicle. Moreover, the transferring unit 11 transfers the signal, which is output from the electronic device in the vehicle, to the planar element 22 on the basis of the routing table.

The housing 12 houses the transferring unit 11. The housing 12 includes a plurality of (for example, six) wall parts 12*a* and is formed to have a box-like shape. Each wall part 12*a* is formed to have a flat plate shape and each pair of wall parts 12*a* is disposed to face each other; thus, the box-like shape is formed. The housing 12 includes the internal space for housing the transferring unit 11 therein.

Each wall part 12*a* of the housing 12 includes a main body part 12*b* formed to have a plate shape by an insulating member such as resin, and a shield part 12*c* with a conductive property for blocking noise that affects the transferring unit 11. The shield part 12*c* is formed by, for example, providing a conductive metal plate to an external wall surface of the main body part 12*b*. The conductive metal plate is formed in the entire area of the external wall surface of each main body part 12*b*, and provided to each of all the six wall parts 12*a*. Note that the conductive metal plate may be provided to a part of the six wall parts 12*a*. The shield part 12*c* is not limited to the aforementioned structure and may employ another structure. In the shield part 12*c*, for example, each main body part 12*b* itself may be formed by a conductive metal plate. The shield part 12*c* is larger than the planar element 22 when viewed from a stacking direction of the pattern of the planar element 22 stacked on a dielectric body 21, the stacking direction being described later. That is to say, the shield part 12*c* includes an overlapping part that overlaps with the planar element 22 and an extension part that is extended outward from the overlapping part, when viewed from the stacking direction.

The antenna structure 20 includes the dielectric body 21 and the planar element 22 as an antenna element. The dielectric body 21 has the dielectric property, is stacked on the surface of the shield part 12*c*, and is formed to have a flat plate shape. The planar element 22 has the conductive property, is stacked on the side of the dielectric body 21 opposite to the shield part 12*c*, and is formed to have a thin film shape. The planar element 22 has, for example, a rectangular shape but the shape is not limited to the rectangular shape. The planar element 22 is connected to the transferring unit 11 of the router 10 through a connector cable 23.

The antenna structure 20 transmits or receives a radio wave (signal) by using the shield part 12*c* as a ground of the antenna structure 20. The antenna structure 20 transmits the signal output from the router 10, for example, to a communication system 101 outside the vehicle. In addition, the antenna structure 20 receives the signal from the communication system 101 outside the vehicle and outputs the received signal to the router 10.

As described above, the router unit 1 with the antenna according to the embodiment includes the router 10 and the antenna structure 20. The antenna structure 20 is mounted in the vehicle 100 and includes the dielectric body 21 with the dielectric property and the planar element 22 with the conductive property that is provided to the dielectric body 21. The router 10 includes the transferring unit 11 and the housing 12. The transferring unit 11 transfers the signal to the transfer destination. The housing 12 houses the transferring unit 11, and includes the shield part 12*c* with the conductive property for blocking the noise that affects the transferring unit 11. The antenna structure 20 is provided to the shield part 12*c* and is connected to the transferring unit 11. Then, the antenna unit 20 transmits or receives the radio wave by using the shield part 12*c* as the ground of the antenna structure 20.

By this structure, the router unit 1 with the antenna can use the shield part 12*c* of the router 10 also as the ground of the antenna structure 20. Thus, in the router unit 1 with the antenna, the increase in the number of components can be suppressed and accordingly, the enlargement of the device can be suppressed. In addition, since the router unit 1 with the antenna includes the antenna structure 20 in the shield part 12*c* of the router 10, the distance between the router 10 and the antenna structure 20 can be made relatively short and the attenuation of the signal by the connector cable 23 between the router 10 and the antenna structure 20 can be suppressed. The router unit 1 with the antenna can relieve the antenna gain performance and suppress the enlargement of the device. Additionally, the router unit 1 with the antenna can omit a relay unit to be installed between the router 10 and the antenna structure 20. Thus, in the router unit 1 with the antenna, the increase in the number of components is suppressed and the attenuation of the signal is suppressed, and accordingly, the enlargement of the device can be suppressed.

The antenna device 2 includes the antenna structure 20. The antenna structure 20 is mounted in the vehicle 100 and includes the dielectric body 21 with the dielectric property and the planar element 22 with the conductive property that is provided to the dielectric body 21. In the router 10 including the transferring unit 11 that transfers the signal to the transfer destination and the housing 12 that houses the transferring unit 11 and includes the shield part 12*c* with the conductive property for blocking the noise that affects the transferring unit 11, the antenna structure 20 is provided to the shield part 12*c*, connected to the transferring unit 11, and transmits or receives the radio wave by using the shield part 12*c* as the ground of the antenna structure 20. By this structure, the antenna device 2 obtains the effect similar to that of the router unit 1 with the antenna.

In the antenna device 2, the antenna structure 20 transmits the signal output from the transferring unit 11 to the communication system 101 outside the vehicle, or outputs the signal received from the communication system 101 outside the vehicle to the transferring unit 11. By this structure, the antenna device 2 can communicate with the outside of the vehicle 100.

In the antenna device 2, the shield part 12*c* is larger than the planar element 22 when viewed from the stacking direction of the pattern of the planar element 22 stacked on the dielectric body 21. By this structure, the antenna device 2 can secure the antenna gain as appropriate.

Modification

Figure 4:
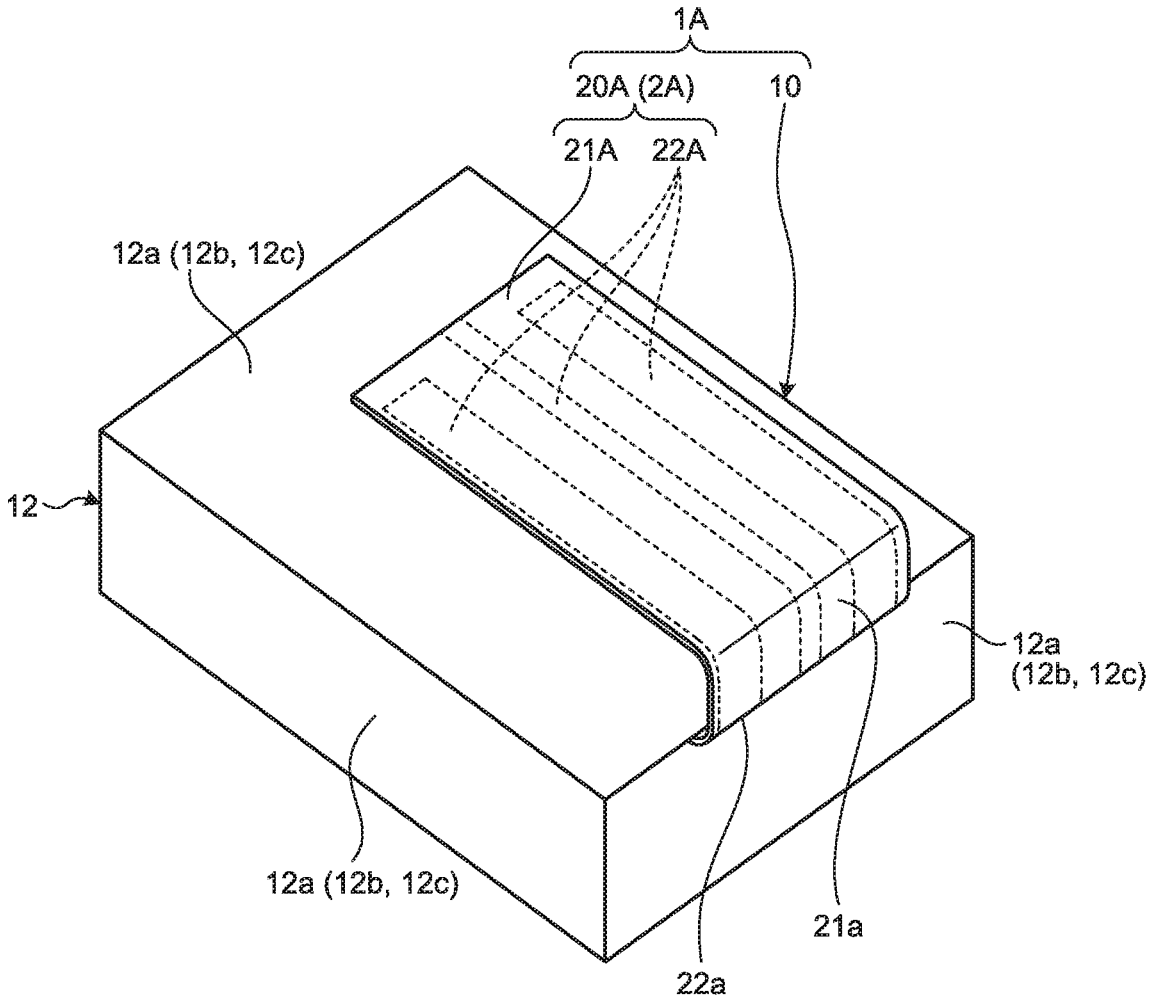
FIG. 4 is a perspective view illustrating a structure example of a router unit with an antenna according to a modification of the embodiment.

Next, a modification of the embodiment is described. In the modification below, the component equivalent to that of the embodiment is denoted by the same reference sign and the detailed description of the corresponding component is omitted. FIG. 4 is a perspective view illustrating a structure example of a router unit 1A with an antenna according to the modification of the embodiment. The router unit 1A with the antenna is different from the router unit 1 with the antenna according to the embodiment in that the router unit 1A includes a monopolar element 22A instead of the planar element 22.

The router unit 1A with the antenna (antenna device 2A) includes the router 10 and an antenna structure 20A as illustrated in FIG. 4. The antenna structure 20A includes a dielectric body 21A and the monopolar element 22A as the antenna element.

The dielectric body 21A is formed to have a sheet shape, and is disposed to face the shield part 12*c* of the router 10 with a distance therebetween in the stacking direction. Then, the dielectric body 21A includes a bent part 21*a* corresponding to one end of the dielectric body 21A that is bent toward the shield part 12*c*. Between the dielectric body 21A and the shield part 12*c*, a supporting member (not shown) such as a foamed material with a dielectric property is provided. The supporting member supports the dielectric body 21A, and maintains the gap between the dielectric body 21A and the shield part 12*c* constant.

The monopolar element 22A has the conductive property, is stacked on the shield part 12*c* side of the dielectric body 21A, and is formed to have a thin film shape. That is to say, the monopolar element 22A is provided to the dielectric body 21A on a side (inner side) that faces the shield part 12*c*. The monopolar element 22A is connected to the transferring unit 11 of the router 10 through a connector cable (not shown). The monopolar element 22A includes a capacitive coupling part 22*a* that is capacitively coupled with the shield part 12*c* in a manner that a part of the monopolar element 22A is overlapped with the shield part 12*c* through the dielectric body 21A at the bent part 21*a*. The antenna structure 20A transmits or receives the radio wave by using the shield part 12*c* as the ground of the antenna structure 20A.

As described above, in the router unit 1A with the antenna (antenna device 2A), the dielectric body 21A is formed to have the sheet shape, is disposed to face the shield part 12*c* with a distance therebetween, and includes the bent part 21*a* corresponding to one end of the dielectric body 21A disposed to face the shield part 12*c*, the one end being bent toward the shield part 12*c*. The monopolar element 22A is provided to the dielectric body 21A on the side of the shield part 12*c* and includes the capacitive coupling part 22*a* that is capacitively coupled with the shield part 12*c* in a manner that a part of the monopolar element 22A is overlapped with the shield part 12*c* through the dielectric body 21A at the bent part 21*a*. The antenna structure 20A transmits or receives the radio wave by using the shield part 12*c* as the ground of the antenna structure 20A. By this structure, the router unit 1A with the antenna (antenna device 2A) obtains the effect similar to that of the router unit 1 with the antenna (antenna device 2) according to the embodiment.

In the above example, the antenna structure 20 transmits the signal, which is output from the transferring unit 11, to the communication system 101 outside the vehicle or outputs the signal, which is received from the communication system 101 outside the vehicle, to the transferring unit 11; however, the present invention is not limited to this example. The antenna structure 20 may transmit the signal, which is output from the transferring unit 11, to a communication unit inside the vehicle or output the signal, which is received from the communication unit inside the vehicle, to the transferring unit 11.

The planar element 22 and the monopolar element 22A are described as the antenna elements; however, the antenna element is not limited to the aforementioned element and may be an antenna with another shape.

The antenna structure 20 includes one planar element 22 and the antenna structure 20A includes one monopolar element 22A; however, the number of elements is not limited to this number and each of the antenna structures 20 and 20A may include a plurality of, and a plurality of kinds of antenna elements.

In the antenna device and the router unit with the antenna according to the embodiment, the increase in the number of components can be suppressed and the attenuation of the signal can be suppressed by the use of the shield part of the router as the ground of the antenna structure.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An antenna device, comprising:

an antenna structure that is mounted in a vehicle, and includes a dielectric body with a dielectric property and an antenna element with a conductive property that is provided to the dielectric body, wherein in a router including a transferring unit that transfers a signal to a transfer destination and a housing that houses the transferring unit and includes a shield part with a conductive property for blocking noise that affects the transferring unit, the antenna structure is provided to the shield part, connected to the transferring unit, and transmits or receives a radio wave by using the shield part as a ground of the antenna structure, the dielectric body is formed to have a sheet shape, is disposed to face the shield part with a distance therebetween, and includes a bent part corresponding to one end of the dielectric body disposed to face the shield part, the one end being bent toward the shield part, the antenna element is provided to the dielectric body on a side of the shield part and includes a capacitive coupling part that is capacitively coupled with the shield part in a manner that a part of the antenna element is overlapped with the shield part through the dielectric body at the bent part, and the antenna structure transmits or receives the radio wave by using the shield part as the ground of the antenna structure.

2. The antenna device according to claim 1, wherein the antenna structure transmits the signal, which is output from the transferring unit, to a communication system outside the vehicle or outputs the signal, which is received from the communication system outside the vehicle, to the transferring unit.

3. The antenna device according to claim 2, wherein the shield part is larger than the antenna element when viewed from a stacking direction of a pattern of the antenna element stacked on the dielectric body.

4. The antenna device according to claim 1, wherein the shield part is larger than the antenna element when viewed from a stacking direction of a pattern of the antenna element stacked on the dielectric body.

5. A router unit with an antenna, comprising:

an antenna structure that is mounted in a vehicle, and includes a dielectric body with a dielectric property and an antenna element with a conductive property that is provided to the dielectric body; and a router including a transferring unit that transfers a signal to a transfer destination and a housing that houses the transferring unit and includes a shield part with a conductive property for blocking noise that affects the transferring unit, wherein the antenna structure is provided to the shield part, connected to the transferring unit, and transmits or receives a radio wave by using the shield part as a ground of the antenna structure, the dielectric body is formed to have a sheet shape, is disposed to face the shield part with a distance therebetween, and includes a bent part corresponding to one end of the dielectric body disposed to face the shield part, the one end being bent toward the shield part, the antenna element is provided to the dielectric body on a side of the shield part and includes a capacitive coupling part that is capacitively coupled with the shield part in a manner that a part of the antenna element is overlapped with the shield part through the dielectric body at the bent part, and the antenna structure transmits or receives the radio wave by using the shield part as the ground of the antenna structure.

* * * * *